United States Patent [19]

Granat

[11] 3,940,005

[45] Feb. 24, 1976

[54] SAFETY CLOSURE MEANS FOR PRESSURIZED BOTTLES AND OTHER LIKE CONTAINERS

[75] Inventor: Rodney John Granat, Caulfield, Australia

[73] Assignee: A.C.I. Operations Pty. Limited, Melbourne, Australia

[22] Filed: Apr. 11, 1974

[21] Appl. No.: 460,199

[52] U.S. Cl. ..... 215/325; 215/341; 215/354

[51] Int. Cl.[2] ..... B65D 41/60

[58] Field of Search ..... 215/270, 277, 354, 358, 215/361, 350, 341; 220/233, 234, 254, 256; 53/15, 43

[56] References Cited

UNITED STATES PATENTS

| | | | |
|---|---|---|---|
| 2,681,742 | 6/1954 | Miller | 215/350 |
| 2,916,174 | 12/1959 | Orr | 215/341 X |
| 2,993,612 | 7/1961 | Trautvetter | 215/354 X |
| 3,244,308 | 4/1966 | Esposito | 215/354 X |
| 3,788,510 | 1/1974 | Collins | 215/341 |

FOREIGN PATENTS OR APPLICATIONS

| | | | |
|---|---|---|---|
| 84,814 | 3/1958 | Denmark | 215/277 |
| 505,504 | 9/1951 | Belgium | 215/350 |

*Primary Examiner*—Donald F. Norton
*Attorney, Agent, or Firm*—Cushman, Darby & Cushman

[57] ABSTRACT

Safety closure means for bottles and other like containers of sparkling wines or other liquids comprises, in combination an outer cap or capsule adapted to enclose the container neck and to be securely retained thereto, and a self-releasing plug of elastomeric material movably arranged within and retained to said cap or capsule to enable the latter and the plug to be applied together to the container and to be similarly removed therefrom thus reducing the risk of injury by a violently ejected plug.

The plug comprises a tube having therein a generally transverse integral partition having a single position of equilibrium in which at least an outer annular portion thereof extends downwardly and outwardly towards the tube.

The partition is also formed with a centrally located upward projection which is engaged and depressed by the top of the cap as the latter is being applied to the container neck, thereby causing said outer annular portion of the partition to exert an outward thrust on the plug tube. This tube is therefore expanded into effective sealing contact with the interior of the container neck.

When subsequently the cap is being removed from the container the resilient plug tends to return to its normal unstrained or equilibrium condition and is thus freely removable from the neck and generally comes off with the cap.

13 Claims, 5 Drawing Figures

SAFETY CLOSURE MEANS FOR PRESSURIZED BOTTLES AND OTHER LIKE CONTAINERS

Figure 1:
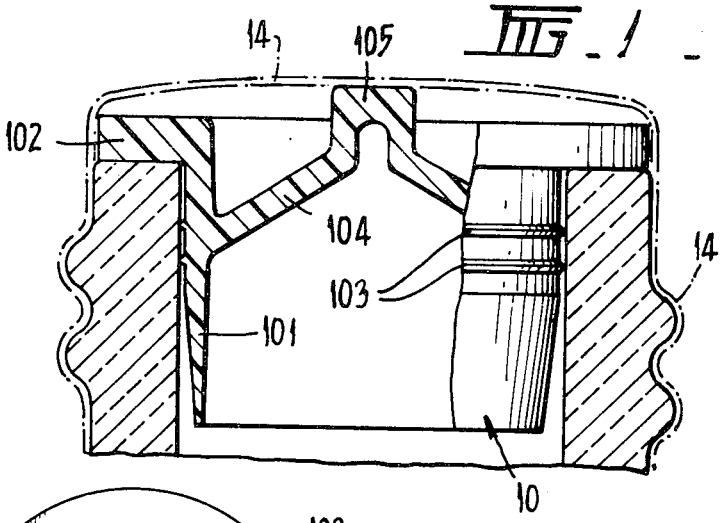

This invention relates to safety closure means for bottles or other containers and has been devised primarily for use in sealing bottles of sparkling wines or other liquids which, like sparkling wines are required to be sealed in opposition to the pressure of gases dissolved therein;

It is now a common practice to seal bottles of sparkling wine with moulded plastic plugs, in lieu of cork plugs or stoppers, the said plastic plugs being generally covered by a cap or capsule, e.g. a screw cap of tinplate or other suitable material, detachably secured to the exterior of the bottle neck.

One disadvantage of many existing plastic plugs of the aforesaid kind is that they are insufficiently resilient for effective sealing engagement unless the internal or bore diameter of the bottle neck lies within a very narrow range of bore tolerances and as it is difficult to maintain the required order of accuracy, it is commonly found to be necessary to reject a variable proportion of the bottles produced.

A further disadvantage of most existing plastic plugs is that they require the application of considerable pressure for insertion into a bottle neck and this necessitates the use of sophisticated and expensive capping machines which generally operate at undesirably low production rates. Also, it is found in many cases that the plugs engage the interior of the neck so tightly that they are difficult to remove, even with the aid of a knife or other tool with the consequent risk of injury to the person removing the plug.

It is therefore an object of this invention to provide improved closure means adapted to obviate or minimize all these disadvantages.

Accordingly, the invention provides a safety closure means for bottles and like containers of sparkling wines and the like comprising a cap or capsule for enclosing and being removably secured to the container neck, and a self-releasing plug of elastomeric material movably arranged within and retained to the cap or capsule so as to be applied therewith to the container wherein the plug includes a tubular member insertible into the neck and a generally transverse partition member arranged within and integral with said tubular member and forming an airtight barrier therein, said partition member having a single position of equilibrium in which at least an outer annular portion thereof extends downwardly and outwardly towards the tubular member, and wherein a substantially centrally located portion of said partition member projects upwardly so as to be engageable and depressible by the top of the cap or capsule during its application to the container neck, thereby to cause said outward and downwardly extending annular portion to exert an outward thrust on the tubular member and so expand the latter into effective sealing engagement with the container neck and whereby, when said downward pressure is relieved during removal of the cap or capsule from the neck, the partition member tends to returns to its said equilibrium position so that the tubular member resiliently contracts to permit of the easy removal of the plug together with the cap or capsule.

For the aforesaid purpose, the said upwardly projecting portion of the partition member is preferably engageable and depressible by the external cap or capsule so that the plug is automatically expanded as the external closure is secured to the container and automatically contracts when said closure is removed. For this purpose, the upper end of said upwardly projecting portion of the partition member is normally disposed above the plane of the upper end of said tubular member of the plug.

More particularly, the said transverse partition member preferably comprises an outwardly and downwardly extending outer annular portion of conical form which is integrally connected to the tubular member at an intermediate position in its length, and an axially disposed upward projection which has its lower end integrally connected to the inner periphery of said conical annular portion. An annular neck of reduced thickness is preferably provided between said conical annular portion and the said projection to form a pivotal or flexing zone while alternatively or in addition, a similar annular neck may be provided between the said conical annular portion and the said tubular member.

The lower end portion of said tubular member is preferably tapered downwardly at a small angle to facilitate insertion of the plug into the container neck.

The upper end of said tubular member is preferably formed with an external circumferential flange to seat on the top of the container neck and so limit the extent to which the plug may be inserted into the container neck. This flange also serves to frictionally retain the plug to the cap or capsule and for this purpose the periphery of the flange may be formed with a flexible circumferential extension of reduced thickness to facilitate attachment of the plug to the interior of a cap or capsule.

During removal of the cap or capsule from the container neck the consequent contraction of the plug permits of the venting of gas under pressure from the container and this generally produces a distinct "pop" sound which, particularly for sparkling wines, is considered to be a desirable attribute. Also, the pressure within the container usually ejects the then contracted plug as the external closure is being removed, thereby substantially obviating the risk of violent ejection of the plug from the bottle after removal of the cap.

The said tubular member may be provided externally with one or a plurality of spaced circumferential ribs which enhance the sealing action and also serve to improve the quality of the "pop" sound, when the plug breaks sealing contact with the bottle neck, such rib or ribs preferably being arranged in or close to the transverse plane in which said partition member is integrally connected to the interior of said tubular member.

The invention also includes in combination, a container having a neck fitted with and sealed by a self-releasing plug, as above described, and an external cap or other closure secured to the exterior of the neck and maintaining the central portion of the partition member of the plug in a depressed condition whereby it maintains the plug in expanded sealing engagement with the interior of the neck.

Figure 2:
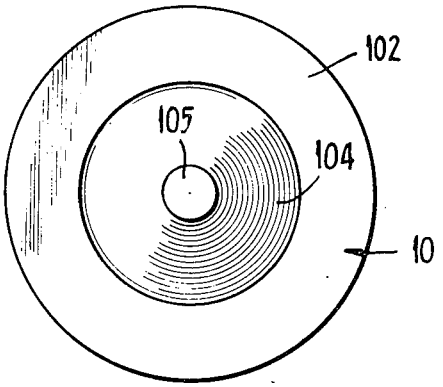
Figure 3:
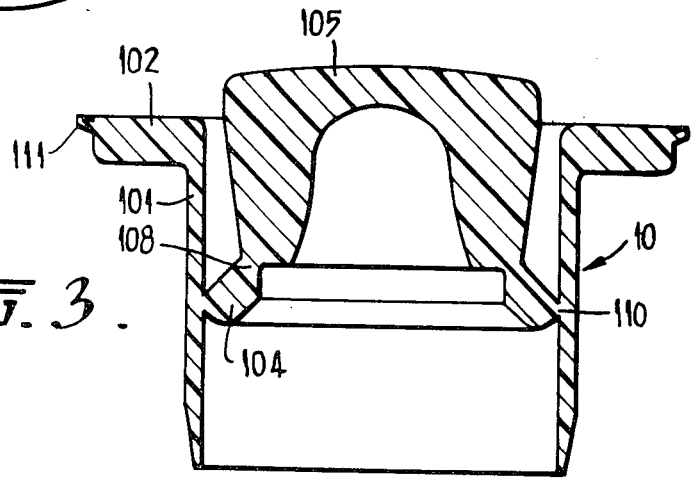
Figure 4:
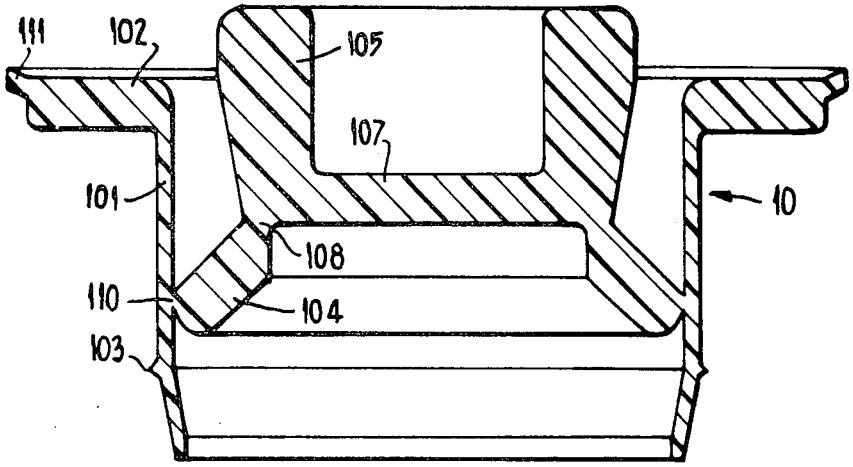
Figure 5:
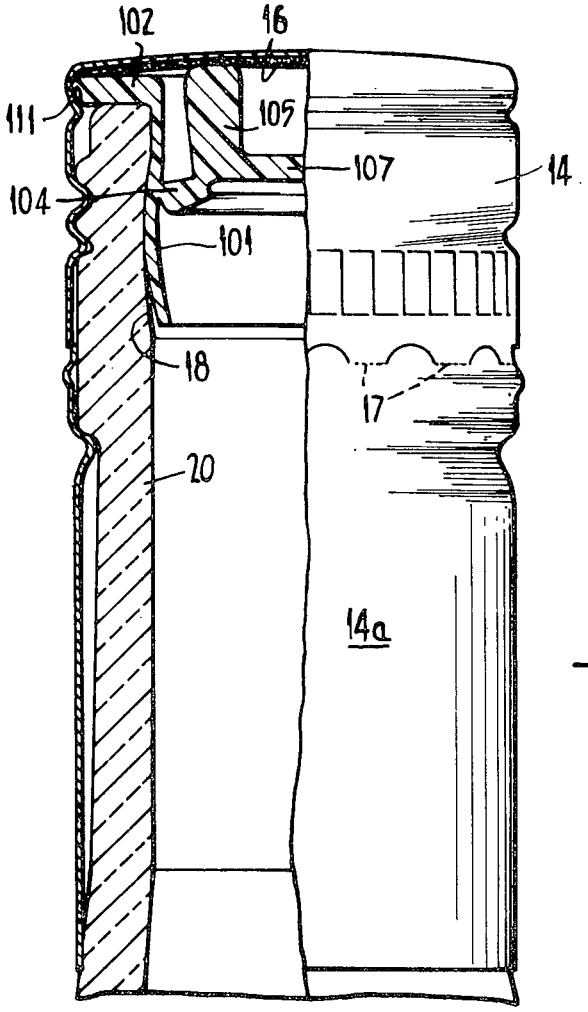

In order however, that the invention may be more clearly understood, representative examples of plugs in accordance therewith are more fully described below with reference to the accompanying drawings in which:

FIG. 1 is an enlarged view partly in elevation and partly in section of combined cap and plug according to the invention, the plug being shown arranged within the neck of a bottle, FIG. 2 is a view in plan to a smaller scale of the plug shown in FIG. 1, FIG. 3 is a view in sectional elevation to a still larger scale showing a modified form of plug for use according to the invention, FIG. 4 is also a view similar to FIG. 3 and shows a further modified form of plug for use according to the invention, and FIG. 5 is an elevational cut out view of the plug of FIG. 4 held in sealing contact with a container neck by a cap.

The plug or stopper, generally designated 10, in FIGS. 1 and 2 is of circular shape in plan, and may be formed of any suitable elastomeric material, e.g. polyethylene.

This plug comprises a tubular member 101, the external diameter of which is slightly less than the internal diamter of the neck of the bottle 12 so that it may easily be inserted therein and its upper end is formed with an outwardly projecting circumferential flange 102 which seats on the top of the bottle neck and so limits the extent to which the plug may be inserted. A spaced pair of shallow circumferential ribs 103 are formed on the exterior of the tube at a suitable distance below the flange, though these ribs are not essential and may be omitted if desired.

Below the sealing ribs, the exterior of the tube tapers downwardly at a small angle so that its free lower end will more freely enter the bottle mouth.

The interior of the tubular member 101 is closed by a generally transverse partition member which is integral with the tubular member 101 and which forms an airtight barrier within it. This partition member comprises a concentric annular conical portion 104 which inclines downwardly and outwardly to its junction with the wall of the tubular member 101, and an axially located projection 105 which is hollow at its underside and which extends upwardly from the inner periphery of the annular portion 104. The free upper end of this axial projection is normally disposed above the level of the top of the flange 102. As shown in the drawing, the junction between the conical annulus 104 and the interior of the tube 101 is disposed approximately in the plane of the sealing ribs 103.

After the plug has been inserted into the bottle neck as shown, an external cap or capsule 14 shown in broken lines, is applied and secured thereto. The ilustrated cap is preformed with a threaded skirt for engagement with a screw thread on the exterior of the bottle neck and the cap is shown as being only partly screwed down, so that the plug 10 is still in its normal or unstrained condition. In many cases however, the screw thread in the cap skirt is formed in situ by a rolling operation after the cap blank has been forced firmly downwards onto the bottle by a capping machine.

In either case, as the cap or capsule 14 and the plug 10 are being applied to the bottle neck, the plug tube 101 is in its normal unstrained condition so that it freely enters the bottle neck until its further inward movement is arrested by the engagement of the external flange 102 thereon, with the top of the bottle neck as shown in FIG. 1. At this time however, the cap 14 is not fully screwed down and during its further downward movement, the plug remains stationary so that the central projection 105 is forced downwardly by the top of the cap. This downward pressure causes the conical annulus 104 to impart an outward and downward thrust to the interior of the tubular member 101 and the outward component of this thrust expands this tube whereby the external sealing ribs 103 are forced into firm sealing contact with the interior surface of the bottle neck. Due to the fact that the plug is thus expanded after it has been inserted into the bottle neck such plugs are suitable for sealing bottle necks having substantially larger bore tolerances than are acceptable for use with plastic plugs of the kinds now commonly used.

Also, whereas conventional plastic plugs used for sparkling wines are sometimes violently ejected from the bottle neck when the cap is removed, a plug according to the present invention is much less prone to this risk for the reason that it resiliently contracts as the cap is being removed, so that generally the plug tends to come off with the cap. In any case, the risk of its violent ejection is substantially obviated because in its contracted condition it readily vents the high pressure gases.

The modified form of plug shown in FIG. 3 is generally similar as regards its principal features to that shown in FIG. 1. In this modified plug however, the axial hollow projection 105 is relatively much larger in diameter and the radial width of the conical annulus 104 is correspondingly reduced. Due to the larger diameter of the projection 105, the pressure exerted downwardly thereon by the external cap or capsule (not shown) is more uniformly distributed and this may be enhanced, to minimize localised deformation of the co-acting top portion of the cap, by interposing between the cap and the projection 105 a stiff reinforcing disc of metal or plastic similar to the disc designated 16 in FIG. 5. The plug shown in FIG. 3 is also formed with an annular neck 108 of reduced thickness at the junction between the projection 105 and the inner periphery of the conical annulus 104 while a similar annular neck 110 integrally connects the outer periphery of this conical annulus to the tube 101.

These reduced annular necks 108 and 110 form flexing or pivotal zones which facilitate the outward thrusting action of the said conical annulus 104 of the plug.

The wall of the hollow projection 105 is relatively thick to impart increased stiffness thereto for the purpose of resisting the compressive force exerted thereon by the conical annulus 104 during the operation of expanding the tube 101, it being understood that the outward thrust exerted on the tube by this conical annulus is counterbalanced by an inward or compressive force which it exerts on the lower end of the projection.

In the plug shown in FIG. 3, the outer periphery of the flange 102 at the top of the tubular portion 101 is formed with a thin and flexible outward extension or rim 111 by which the plug may be retained within a suitable type of cap or capsule 14 before the latter together with the plug is applied to the bottle or the like. Thus, the bottle may be stoppered in a single operation whereas conventionally two separate and successive operations are required, i.e. insertion of the plug in the bottle neck followed by application of the external cap or capsule.

During application of a cap, with the plug retained thereto as above described, the flexible tube 101 is unexpanded so that it freely enters the bottle neck. However, as the cap is being secured to the bottle, it engages and depresses the axial projection 105 of the plug so that the tubular portion 101 of the latter is expanded into firmly sealing engagement with the neck as previously described. It will be apparent also that the then compressed flexible rim 111 on the plug facilitates its removal with the cap or capsule when the latter is subsequently removed from the bottle.

The plug or stopper shown in FIG. 4 differs from that shown in FIG. 3, in that the projection 105 has the form of a tube which is open at the top and is closed at its lower end by a relatively thick and stiff integral panel 107 which more effectively resists compression of the lower end of the projection by the inwardly directed reaction force imparted thereto as the tubular portion 101 is being expanded, thereby ensuring a more effective sealing action. It will be observed that this plug is also shown as being provided with a shallow circumferential sealing rib 103 to improve the quality of the "pop" which is heard when the plug is removed from the neck of a bottle containing sparkling wine or other liquid under pressure.

FIG. 5 shows a plug as illustrated in FIG. 4 in sealing engagement with the neck of a bottle 20 and retained thereto by a conventional pilferproof cap comprising an upper screw cap portion 14 and an integral depending skirt 14*a* which is connected thereto by a ring of spaced narrow elements provided with score lines 17 whereby they are readily ruptured as the screw cap 14 is being unscrewed.

In order to minimise deformation of the top of the cap 14 by the pressure exerted upwardly thereon by the depressed projection 105 of the plug, a reinforcing disc 16 of stiff metal or plastic may be provided between the plug and cap thereby to distribute this reaction pressure over the top of the cap.

The downward pressure exerted on the plug by the cap tends to bulge the tubular portion 101 outwardly in the plane of the junction between its inner surface and the outer periphery of the conical annulus 104 and advantage may be taken of this bulging tendency to obtain a still more effective sealing action by forming the interior of the bottle neck with a conforming shallow groove 18 as shown.

I claim:

1. A resealable safety closure which can be applied by conventional high speed capping equipment to annular openings in necked containers, said closure comprising metal capsule means having a crown and a skirt depending thereform, said capsule means adapted to enclose at least a portion of the neck of said container and being convertible into a removably secured cap means by the in situ formation of screw threads thereon by a rolling operation while said capsule means is fitted on said neck, and self-releasing plug means at least partly enclosed by and retained by said capsule means so that same may be simultaneously applied to and removed from said container, said plug means comprising tubular member means readily insertable into the container opening, flange means near one end of said tubular member means and retained by the interior of said capsule means in axially slidable relationship thereto, said flange means adapted to seat upon the area of the container adjacently surrounding the opening when said tubular member means is disposed within the opening to limit movement of the tubular member means into the opening, said tubular member means including transversely expandable annular sealing area means located along said tubular member means an axial distance below said flange means sufficient to avoid substantial restriction by said flange means of transverse expansion of said sealing area means, button member means located radially centrally of said tubular member means and engageable with the interior crown of said capsule means, connecting means connecting said button means to said sealing area means wherein axial movement of said button means is translated by said connecting means to transverse movement of said sealing area means, said sealing area means capable of variation of expansion, for a predetermined axial movement of said button means, with the diameter of the opening of the container to effectively seal a relatively wide range of diameters of contents said connecting means including relatively rigid inclined wall means, a relatively flexible annular first hinge means connecting said wall means to said sealing means, a relatively flexible annular second hinge means connecting said wall means to said button means, said inclined wall means extending downwardly and outwardly from said second hinge means to said first hinge means, said connecting means being transversely narrower in axial cross section than said button means, said first and said second hinge means being axially substantially thinner and transversely substantially narrower than said inclined wall means, said cap means which is formable from said capsule means and said plug means cooperating so that when said capsule means is moved from an unsealed position to a sealed position, and converted to said cap means by screw thread formation, i. said button means is moved fron an equilibrium position to an axially lower depressed position, ii. said connecting means translates the axial movement of said button means into transverse expansion of said sealing area means from an unsealed position to a sealed position against the interior of said container neck, said cap and said plug means furthermore cooperating so that when said cap is in said sealed position, i. said button means is axially depressed, ii. said plug means is in an unstable position, iii. said sealing area means is in a transversely expanded position of sealing engagement against the interior neck of said container, said plug means then forming an air-tight barrier between the container contents and the surrounding atmosphere, and iv. said second hinge means is axially closer to said flange means than said first hinge means, said cap movable from said sealed position into an unsealed position by unscrewing same, said cap and said plug means cooperating when said cap is in said unsealed condition so that i. said button means is in an equilibrium position, ii. said plug means is in an equilibrium positon, and iii. said sealing area means is out of sealing engagement with the interior neck of said container.

2. Closure of claim 1, wherein said second hinge means connects said wall means at least in part to the bottom of said button means.

3. Closure of claim 1, wherein said inclined wall forms an angle of about 45° with said tubular member.

4. Closure of claim 3, wherein said wall means is connected to the bottom edge of the button means.

5. Closure of claim 2, wherein at least one hinge area is at least in part defined by an annular groove in said connecting means.

6. Closure of claim 5, wherein at least one annular groove is formed on the side of the connecting means exposed to container contents.

7. Closure of claim 6, wherein each hinge is at least partly defined by an annular groove on the side of said connecting means exposed to container contents.

8. Closure of claim 7, wherein said plug means when in said position of instability is under such stress that when the container contains carbonated wine and said cap is moved to the unsealed position, said sealing area means moves relatively suddenly from said transversely expanded position to the position of equilibrium, producing an audible pop from relief of container internal pressure.

9. Closure of claim 8, wherein said button means axially extends above said flange when in said equilibrium position.

10. Closure of claim 9, wherein said tubular member extends in a skirt axially below said sealing area means, and at least a part of said skirt is tapered to facilitate insertion thereof into said opening.

11. Closure of claim 10, wherein said button means includes a substantially transverse annular disc forming the bottom of said bottom means, and cap engaging means extending axially upwardly therefrom.

12. A sealed bottle of sparkling wine or the like, said bottle having a neck defining an opening from the surrounding atmosphere to the bottle interior, said opening sealed against the passage of air by a resealable safety closure, said closure comprising the combination of a removably secured metal cap means and a self-releasing plug means, said cap means having a crown and a skirt depending therefrom and screw threads on said skirt, said plug means at least partly enclosed by and retained by said cap means so that same may be simultaneously removed from and reapplied to said bottle, said plug means comprising tubular member means readily insertable into said opening, flange means near one end of said tubular member means and retained by the interior of said cap means in axially slidable relationship thereto, said flange means adapted to seat upon the area of the bottle adjacently surrounding the opening when said tubular member means is disposed within the opening to limit movement of the tubular member means into the opening, said tubular member means including transversely expandable annular sealing area means located along said tubular member means an axial distance below said flange means sufficient to avoid substantial restriction by said flange means of transverse expansion of said sealing area means, button member means located radially centrally of said tubular member means and engageable with the interior crown of said cap means, connecting means connecting said button means to said sealing area means wherein axial movement of said button means is translated by said connecting means to transverse movement of said sealing area means, said sealing area means capable of variation of expansion, for a predetermined axial movement of said button means, with the diameter of the opening of the bottle to effectively seal a relatively wide range of diameters of bottle openings against leakage of bottle contents said connecting means including relatively rigid inclined wall means, a relatively flexible annular first hinge means connecting said wall means to said sealing area means, a relatively flexible annular second hinge means connecting said wall means to said button means, said inclined wall means extending downwardly and outwardly from said second hinge means to said first hinge means, said connecting means being transversely narrower in axial cross section than said button means, said first and second hinge means axially substantially thinner and transversely substantially narrower than said inclined wall means, said cap means and said plug means cooperating so that when said cap means is in said sealed position, i. said button means is axially depressed, ii. said plug means is in an unstable position, iii. said sealing area means is in a transversely expanded position of sealing engagement against the interior neck of said bottle, said plug means then forming an air-tight barrier between the bottle contents and the surrounding atmosphere, and iv. said second hinge means is axially closer to said flange means than said first hinge means, said cap means movable from said sealed position into an unsealed position by unscrewing same, said cap means and said plug means cooperating when said cap means is in said unsealed condition so that i. said button means has moved to an axially higher equilibrium position, ii. said plug means is in an equilibrium position, and iii. said sealing area means is out of sealing engagement with the interior neck of said bottle.

13. A plug means for use in a resealable safety closure, which closure can be applied by conventional high-speed equipment to annular openings in necked containers, wherein the closure also includes metal capsule means having a crown and a skirt depending thereform, said capsule means adapted to enclose at least a portion of the neck of said container and being convertible into a removably secured cap means by the in situ formation of screw threads thereon by a rolling operation while said capsule is fitted on said neck, said plug means when used in said safety closure being at least partly enclosable by and retainable by said capsule means so that same may be simultaneously applied and removed from the container, said plug means comprising tubular member means readily insertable into a container opening, flange means near one end of said tubular member means and retainable by the interior of said capsule means in axially slidable relationship thereto, said flange means adapted to seat upon the area of the container adjacently surrounding the opening when said tubular member means is disposed within the opening to limit movement of the tubular member means into the opening, said tubular member means including transversely expandable annular sealing area means located along said tubular member means an axial distance below said flange means sufficient to avoid substantial restriction by said flange means of transverse expansion of said sealing area means, button means located radially centrally of said tubular member means and engageable with the interior crown of said capsule means, connecting means connecting said button means to said sealing area means wherein axial movement of said button means is translated by said connection means to transverse movement of said sealing area means, said sealing area means capable of expansion, for a predetermined axial movement of said button means, with the diameter of the opening of the container to effectively seal a relatively wide range of diameters of container openings against leakage of container contents said connecting means including relatively rigid inclined wall means, a relatively flexible annular first hinge means connecting said wall means to said sealing area means, a relatively flexible annular second hinge means connecting said wall means to said button means, said inclined wall means extending downwardly and outwardly from said second hinge means to said first hinge means, said connecting means being transversely narrower in axial cross section than said button means, said first and said second hinge means being axially substantially thinner and transversely substantially narrower than said inclined wall means, said plug means cooperable with said cap means so that when said cap is secured to said container, i. said button means is axially depressed, ii. said plug means is in an unstable position, iii. said second hinge means is axially closer to said flange means than said first hinge means, and iv. said sealing area means is in a transversely expanded position of sealing engagement against the interior neck of said container, said plug means then forming an air-tight barrier between the container contents and the surrounding atmosphere, said plug means further cooperable with said cap means so that when said cap means is unscrewed from said container, i. said button means is in an equilibrium position, ii. said plug means is in an equilibrium position, and iii. said sealing area means is out of sealing engagement with the interior neck of said container.

* * * * *